US006343426B1

(12) United States Patent
Robbins

(10) Patent No.: US 6,343,426 B1
(45) Date of Patent: Feb. 5, 2002

(54) RESILIENT SOLE FOR USE IN ARTICLES OF FOOTWEAR TO ENHANCE BALANCE AND STABILITY

(76) Inventor: Steven E. Robbins, 45 Birchview, Dollard des Ormeaux, Quebec (CA), H9A 2Y3

( * ) Notice: Subject to any disclaimer, the term of this patent is extended or adjusted under 35 U.S.C. 154(b) by 618 days.

(21) Appl. No.: 08/873,876

(22) Filed: Jun. 12, 1997

Related U.S. Application Data

(63) Continuation of application No. 08/583,512, filed on Jan. 5, 1996, now abandoned, which is a continuation-in-part of application No. 08/366,587, filed on Dec. 29, 1994, now abandoned.

(51) Int. Cl.[7] ..... A43B 5/00
(52) U.S. Cl. ..... 36/25 R; 36/44
(58) Field of Search ..... 36/25 R, 28, 43, 36/44

(56) References Cited

U.S. PATENT DOCUMENTS

| | | | | | |
|---|---|---|---|---|---|
| 4,435,910 | A | * | 3/1984 | Marc | 36/44 |
| 4,502,234 | A | * | 3/1985 | Schaefer et al. | 36/28 |
| 4,633,598 | A | * | 1/1987 | Moronaga et al. | 36/44 |
| 4,633,877 | A | * | 1/1987 | Pendergast | 36/44 |
| 4,766,679 | A | * | 8/1988 | Bender | 36/30 R |
| 4,823,779 | A | | 4/1989 | Daly et al. | |
| 5,435,077 | A | * | 7/1995 | Pyle | 36/43 |

OTHER PUBLICATIONS

Robbins, Steven, et al., "Athletic Footwear Affects Balance in Men", 1994, British Journal of Sports Medicine.

Robbins, Steven, et al., "Proprioception and Stability: Foot Position Awareness as a Function of Age and Footwear", 1995, Age and Ageing.

Robbins, Steven E., et al., "Sensory Attenuation Induced by Modern Athletic Footwear", 1988, Journal of Testing and Evaluation.

Robbins, Steven, "Shoe Thickness and Hardness Balance in Older Men", Journal of the American Geriatrics Society, 1992.

Steven E. Robbins et al., "Sensory Attenuation Induced by Modern Athletic Footwear", Journal of Testing and Evaluation, vol. 16, No. 4, Jul. 1988, pp. 412–416.

Steven Robbins, MD, et al., "Shoe Sole Thickness and Hardness Influence Balance in Older Men", J Am Geriatr Soc 40:1089–1094, 1992.

Steven Robbins et al., "Proprioception and Stability: Foot Position Awareness as a Function of Age and Footwear", Age and Aging 1995:24:67–72.

Stevens Robbins MD, et al., "Athletic footwear affects balance in men", Br J Sp Med 1994; 28(2)., pp. 117–122.

* cited by examiner

*Primary Examiner*—M. D. Patterson
(74) *Attorney, Agent, or Firm*—Fish & Richardson P.C.

(57) ABSTRACT

A resilient sole for use in an article of footwear. The sole has controlled stiffness and manifests a slow shape recovery following compression by the plantar surface of the foot. A footwear construction using a sole with such characteristics improves stability of users of all age groups, while enhancing comfort.

18 Claims, 4 Drawing Sheets

RESILIENT SOLE FOR USE IN ARTICLES OF FOOTWEAR TO ENHANCE BALANCE AND STABILITY

This is a continuation of application Ser. No. 08/583,512, filed Jan. 5, 1996, now abandoned, which is a continuation-in-part of application Ser. No. 08/366,587, filed Dec. 29, 1994 now abandoned.

FIELD OF THE INVENTION

The present invention relates to the art of footwear construction, more particularly to an improved resilient sole for use in an article of footwear in proximity to the plantar surface of the foot. The sole has a controlled stiffness and exhibits a slow shape recovery following compressive deformation that provides an enhanced stability. The invention also extends to an article of footwear incorporating the improved sole.

BACKGROUND OF THE INVENTION

Most footwear currently purchased are constructed with soft, highly resilient materials in their soles mainly because users find them more comfortable than stiff soled footwear. In addition, shoes with soft, highly resilient soles are thought to benefit athletic users through "cushioning" impacts normally encountered during locomotion or running. Furthermore, these shoes are sometimes thought to provide optimal gait for geriatric users who suffer from frequent falls due to loss of balance.

When these notions are examined scientifically, there is evidence that shoes with soft, highly resilient soles are more comfortable than those with stiffer soles. However, soft resilient soled shoes are not superior in cushioning impact when humans use them. More importantly, recently conducted clinical research clearly suggests that soft highly resilient soled shoes actually destabilize humans of all age groups. In this regard, the reader may refer to the articles entitled "SHOE SOLE THICKNESS AND HARDNESS INFLUENCE BALANCE IN OLDER MEN" published in 1992, in the Journal of the American Geriatrics Society, and "ATHLETIC FOOTWEAR AFFECT BALANCE IN MEN", published in 1994, in the British Journal of Sports Medicine, both authored by the present inventor, demonstrating that stability is impaired in humans of all age groups when sole thickness increases and stiffness decreases. The mechanism causing instability appears complex and varies by age. The present inventor has reported in an article published in 1995, in Age and Ageing, entitled "PROPRIOCEPTION AND STABILITY: FOOT POSITION AWARENESS AS A FUNCTION OF AGE AND FOOTWEAR", that the mechanism may consist of rapid plantar surface angulation caused by material compression causing loss of foot position awareness. Another possible cause of instability reported by the present inventor in 1988, in the Journal of Testing and Evaluation, entitled "SENSORY ATTENUATION CAUSED BY MODERN ATHLETIC FOOTWEAR", consists of sensory insulation caused by the yielding material distributing load more evenly across the plantar surface resulting in a loss of proprioception. The U.S. Pat. No. 4,823,779 issued on Apr. 25, 1989, to the present inventor describes in greater detail the notion of sensory insulation in footwear applications. Another mechanism could be an unstable support base caused by "base shifting" or tilting of the plantar surface with every gait cycle, or a highly resilient material causing an "underdamped" condition characterized by surface oscillation when load is released rapidly and surface rebound when compressed rapidly, both conditions occurring during locomotion. Oscillations can be observed when load was removed during resiliency testing of a highly resilient material typically used in footwear soles.

In short, footwear design using comparatively stiff and thin soles is a sound approach from the perspective of stability enhancement, but is not satisfactory for most consumers because this design yields less comfortable shoes. Therefore, a clear need exists in the industry to improve the comfort of footwear without resorting to highly resilient sole materials known to impair stability.

OBJECTIVES AND STATEMENT OF THE INVENTION

An object of the invention is to provide a sole for an article of footwear that offers good stability and yet possesses a good comfort rating.

Another object of the invention is an article of footwear utilizing the aforementioned sole.

The present inventor has made the unexpected discovery that a sole made of a material having a low resiliency offers enhanced stability during locomotion while providing a degree of comfort comparable to what prior art soles made of materials having a highly resilient character.

From a functional point of view, the sole of a shoe can be viewed as a base on which the foot of the wearer rests. In the case of a highly resilient material the recompression activity taking place at every footstep produces a downward movement of the interface plantar surface/sole, causing a transitory "base shifting" event and perhaps surface oscillation from rebound which may destabilize the wearer. In contrast, a sole made from a low resiliency material offers a much more stable base because the material remains in a compressed condition between footstep without "base shifting" or rebound. This is referred to an "overdamped" condition.

A low resiliency material is characterized by good shape retention properties, "overdamping" characterized by reduction of surface oscillation and lack of rebound on compression, and lack of repeated "base shifting" on recompression. For instance, once the material is subjected to rapid physical deformation there is little or no rebound. Further, when the source of the deformation is removed, it manifests a shape recovery activity as any highly resilient material does, but at a much slower pace, without surface oscillation. In footwear applications this property enables a sole to acquire the shape of the foot for a comparatively long time period, therefore there is no "base shifting" on recompression because when the compressive effort acting on the sole is temporarily discontinued, such as when the individual raises his foot off the ground during gait, the material of the sole does not have enough time to return to its original configuration. In contrast, a traditional sole made of highly resilient material may rebound when loaded. Further it immediately springs back to its native configuration, perhaps with surface oscillations typical of an "underdamped" system. As a result, when the foot pressure is re-applied during the following footstep the sole is in a vertically expanded condition and produces repeated "base shifts", and perhaps rebound and surface oscillation.

The compressed, relatively stiff sole surface encountered by the foot during gait does not create undue discomfort because the sole conforms to the topography of the plantar surface and provides a relatively uniform pressure distribution. In comparison, a flat and substantially unyielding sole creates stress points due to locally acting forces and it is usually perceived by the wearer as being less comfortable.

As embodied and broadly described herein the invention provides a material for use in an article of footwear in proximity to a plantar surface of the foot, said material having a resiliency index in the range from about 0.05 to about 0.5.

The resiliency index is a custom parameter established to quantify the resiliency of the sole following compressive deformation. The test procedure to determine the resiliency index involves observing the amount of shape recovery with relation to time following a predetermined compressive deformation.

More preferably, the resiliency index of the material is in the range from about 0.1 to about 0.35 and most preferably in the range from about 0.1 to about 0.2. In a preferred embodiment, the sole has a hardness in the range from about Shore A2 to about Shore A40. More preferably, the hardness is in the range from about Shore A2 to about Shore A14.

For the purpose of this specification, the term "sole" is intended to designate all or part of the structures intended to be located in proximity to the plantar surface of the foot, i.e., either in direct contact or at a short distance from the plantar surface. As an example, when the article of footwear is in the form of a shoe, "sole" designates the material forming the bottom or a layer of the bottom of the shoe such as the sockliner, insole, midsole and the outer sole as well in some specific applications, or a constituent of these parts. In the case of sockliner and insole, it may be removable from the shoe.

The sole does not need to extend under the entire plantar surface. A structure extending only under the ball of the foot or under the heel will be considered a "sole".

The article of footwear may be a shoe, boot or sock, among others. In the case of a sock, the sole would normally constitute the bottom part of the foot covering material, in a facing relationship with the plantar surface.

As embodied and broadly described herein, the invention also provides an article of footwear including a sole in proximity of a foot receiving surface of said article of footwear, said sole having a resiliency index in the range from about 0.05 to about 0.5.

DESCRIPTION OF PREFERRED EMBODIMENTS

Figure 1:
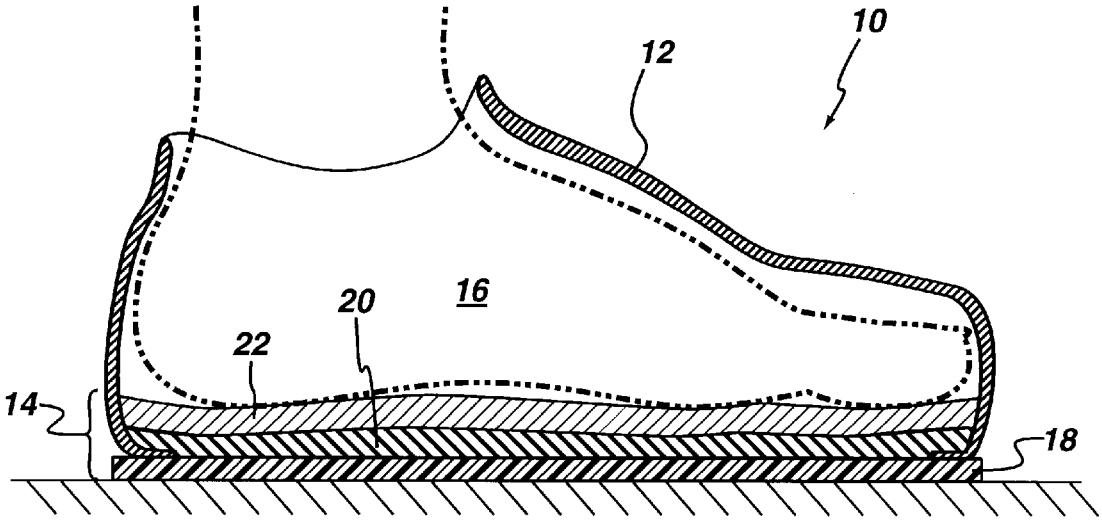
FIG. 1 is a vertical cross-sectional view of a shoe including the sole in accordance with the present invention, the cross-section being taken along the longitudinal axis of the shoe.

With reference to the annexed drawings, FIG. 1 illustrates a shoe designated comprehensively by the reference numeral 10, using the improved sole in accordance with the present invention. The shoe 10 includes a vamp 12 secured to a bottom 14 to form a foot receiving enclosure 16.

The present invention is concerned with the construction of the bottom 14 that determines in large part the comfort potential of the shoe 10 and its stability. The bottom 14 is a layered structure comprising an outer sole 18 made of carbon rubber. If desired, the surface of the outer sole that contacts the ground may be sculptured to create a tread pattern. The outer sole 18 is bonded in a face-to-face relationship with a midsole 20 made of expanded polymer, such as ethylene-vinyl acetate (EVA) copolymer. The midsole has a thickness of about 5 mm and it is comparatively hard (a hardness in excess of A40 is preferred).

The upper layer of the shoe bottom 14 is constituted by an insole 22 that is bonded to the upper surface of the midsole 20. The insole is made from a material selected to provide a resiliency index in the range from about 0.05 to about 0.5, preferably from about 0.1 to about 0.35 and most preferably from about 0.1 to about 0.2.

Figure 3:
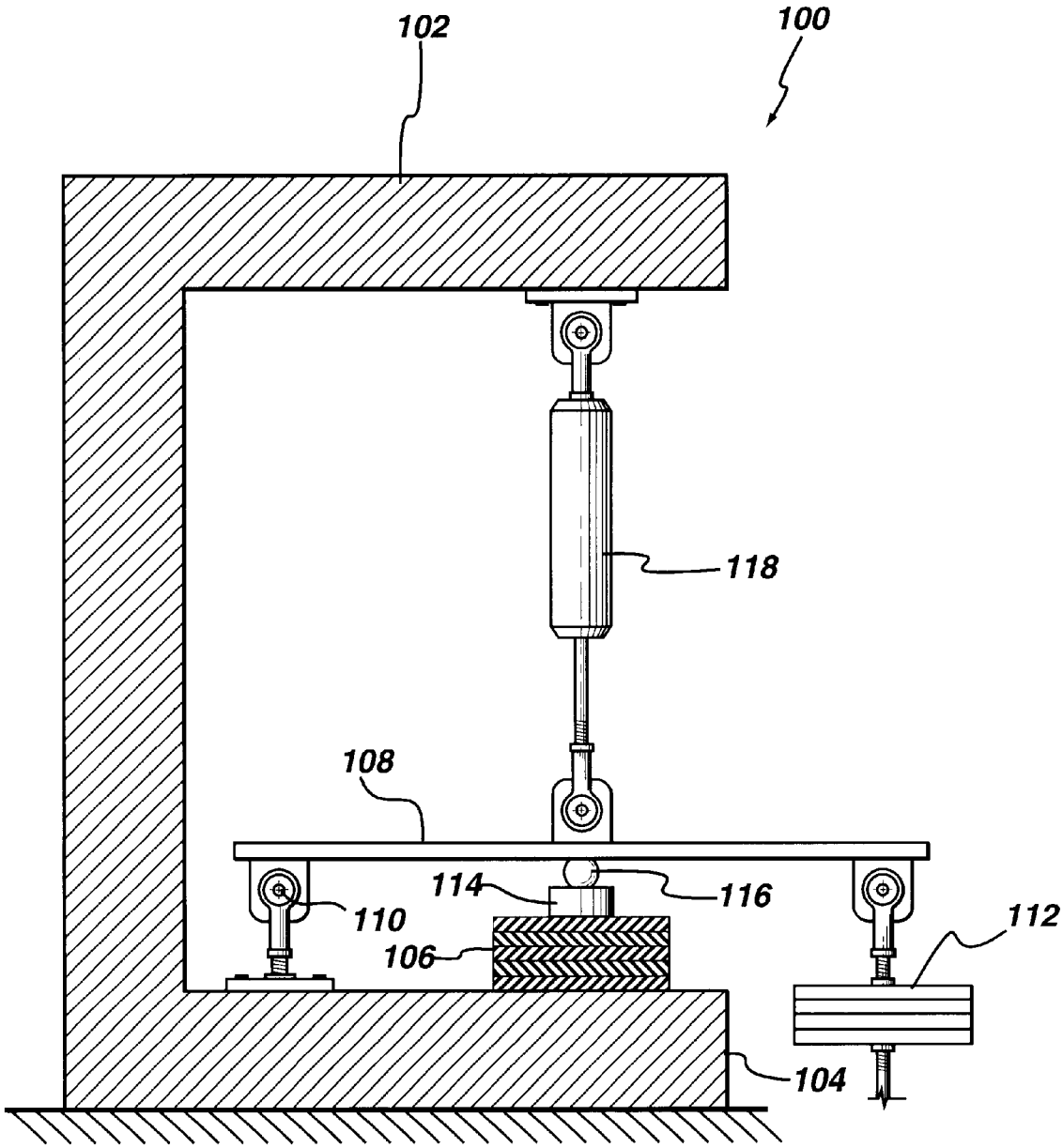
FIG. 3 is a graphical illustration of a set-up for performing a test procedure to measure a resiliency index.

The resiliency index is a custom parameter designed to quantify the rate of recovery of a material with relation to time following a compressive deformation. The measurement procedure is a modification of the standard test ASTM F36-88 designed for assessing compressibility and recovery of gasket materials. FIG. 3 illustrates schematically the testing set-up 100 which comprises a frame 102 having a flat base portion 104 supporting the test specimen 106. A horizontally extending arm 108 is pivotally mounted at 110 to the base portion 104 of the frame. A main load 112 of 3.17 kg is suspended from the free extremity of the arm 108. The distance between the point 110 and the site on the arm 108 at which the main load is attached is 30.48 cm. An anvil 114 made of hardened metallic material is provided for locally compressing the test sample 106. The anvil 114 is in the form of a cylinder having a diameter of 31.8 mm. The horizontal arm 108 applies pressure to the anvil 114 by the intermediary of a ball made of hard metallic material having a diameter of 15.9 mm.

The rate of recovery upon removal of the sample is measured by a linear variable displacement transducer 118 having a maximum range of 2.54 cm (a Penny/Giles transducer available from Durham Instruments, Ontario, Canada has been found satisfactory).

The testing procedure consists of positioning a test specimen having an area of 20 square centimeters ($cm^2$) and a thickness (uncompressed) of 50 mm. The test specimen may entails a single ply or a number of superimposed plies sufficient to give the desired nominal thickness (if there are several plies they should not be bonded or otherwise attached to one another). The assembly formed by the anvil 114, ball 116 and arm 108 (free of the main load 112) is first deposited on the test specimen for a duration of 15 seconds (sec) to create a preload condition of 0.9 kg. This value is the weight that the surface of the specimen "sees" before the application of the main load. The individual weight of the various components, such as the arm 108, ball 116, anvil 114, etc., contributes to this preload condition, thus the materials of these components and their dimensions should be selected to achieve a combined weight creating the desired preload value. The main load 112 of 3.17 kg is then applied to the anvil for a period of 1 minute (min). The main load 112 is instantly removed and the recovery of the test sample is recorded for a period of at least 2 sec. The resiliency index is expressed by the following formula:

$$\frac{R-M}{P-M}$$

where:

R: peak recovered thickness observed within the one second time frame immediately following the removal of main load;

M: thickness under preload and main load; and

P: thickness under preload.

Values R, M and P can be expressed in centimeters (the same units of measure are used for each factor).

It is important to note that the resiliency index of the sole 22 is assessed with the sole removed from the shoe 10, otherwise the results may be corrupted. For composite materials having a variable resiliency index over their surface, the measurement is performed in the region receiving the ball of the foot or the region receiving the heel. Indeed, structures that exhibit different resiliency indices at the ball region and at the heel region are similar to two soles placed side by side. In other words, the ball region is considered to form one sole while the heel region forms another sole. This definition is consistent with the meaning given to "sole" earlier in this specification. More specifically a layer of material does not need to extend under the entire plantar surface to form a sole; the layer may extend only under the ball region or under the heel region to be considered a sole.

The benefits of the invention are realized best when the insole 22 has a hardness within a predetermined range selected to enhance stability. The hardness should be in the range from about Shore A 2 to about Shore A 40, preferably from about Shore A 2 to about Shore A 14. Hardness is measured according to the standard test method for determining rubber property-durometer hardness (Annual book of ASTM Standards, Phila., ASTM, 1988, 09.01, pp 596–600). As in the case of the resiliency index measurement, hardness is determined on a sample separated from the shoe.

The sole 22 preferably has a thickness in the range from about 2 millimeters to about 50 millimeters, more preferably from about 5 millimeters to about 25 millimeters and most preferably from about 12 millimeters to about 20 millimeters.

Figure 4:
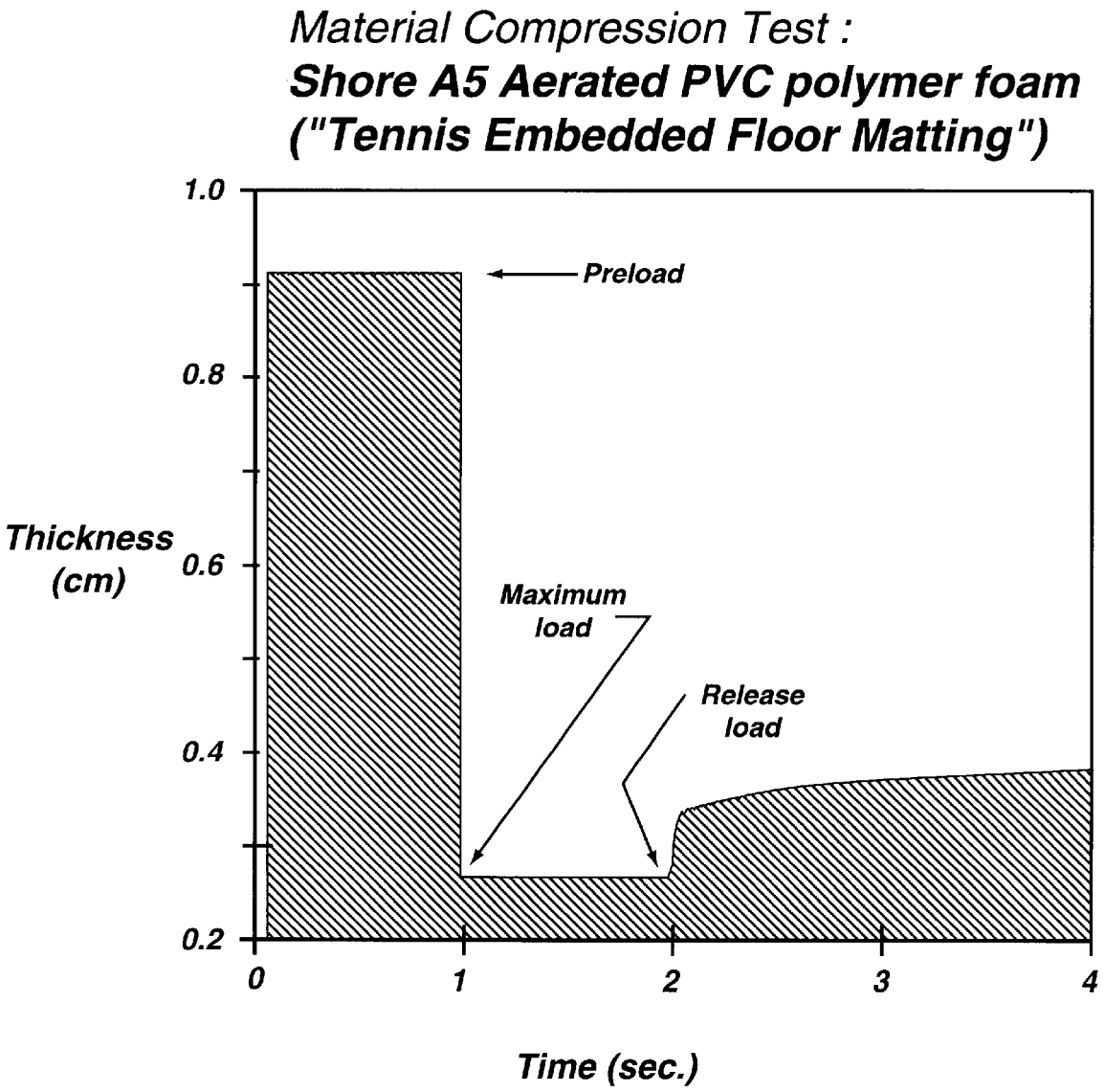
FIG. 4 is a graph illustrating the rate of shape recovery versus time of a material particularly well suited for use as a sole in accordance with the invention; and, FIG. 5 is a graph illustrating the rate of shape recovery versus time of a material not well suited for use as a sole in accordance with the invention.

Expanded polymer, available from Pandel Inc., Atlanta Ga., USA under the designation "TENNIS EMBEDDED FLOOR MATTING" is the material of choice for manufacturing the sole 22. This material is a PVC aerated polymer foam of Shore A5 hardness. FIG. 4 illustrates the low resiliency properties of this material. The resiliency index is assessed with the formula (R–M)/(P–M). The parameters P and M have values of 0.92 cm and 0.28 cm, respectively. R is the peak recovery value within the 2 and 3 second marks on the time axis. The peak is found at the 3 second mark and has a value of 0.38. This produces a resiliency index of 0.156.

Figure 5:
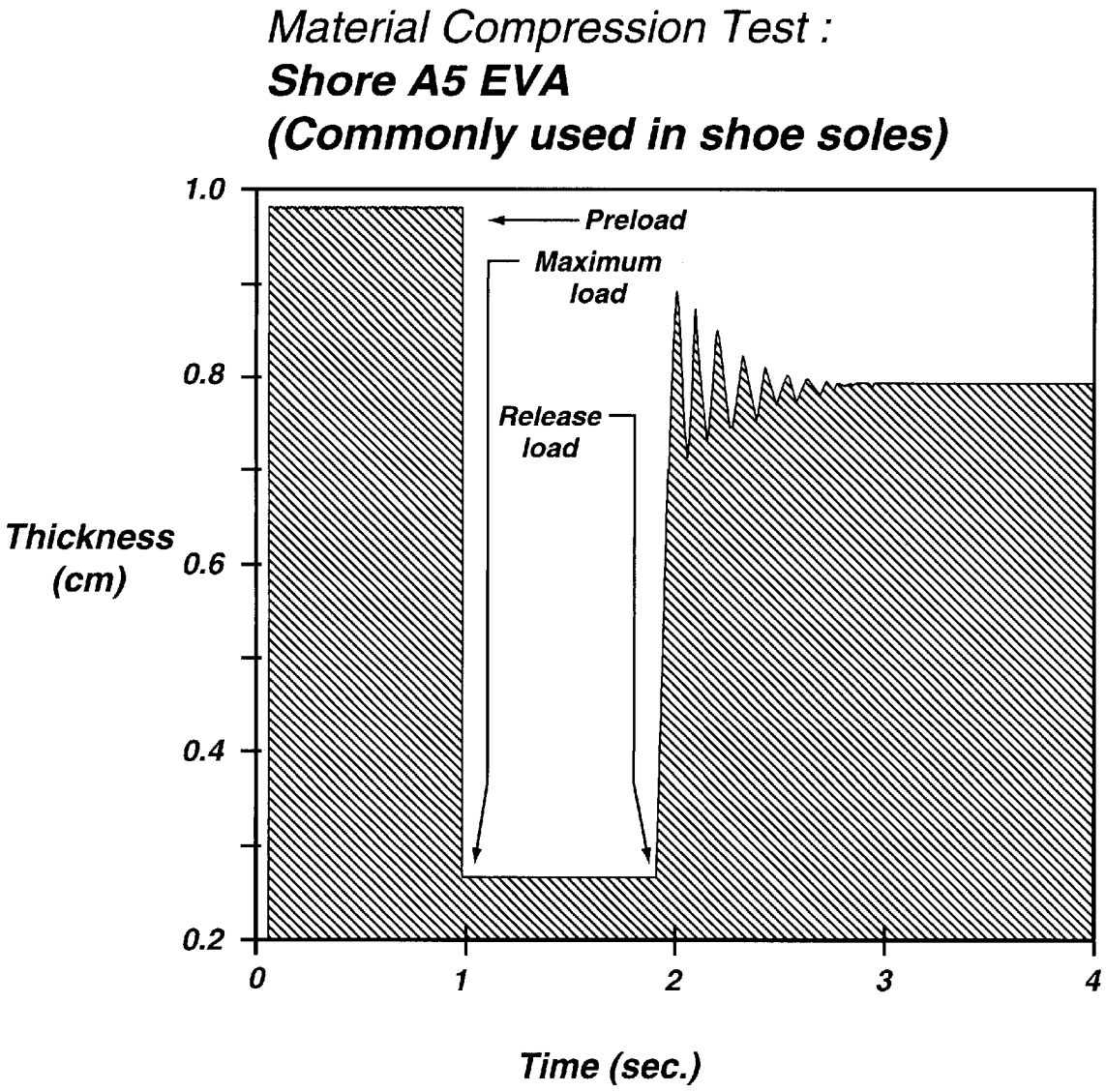

FIG. 5 illustrates for comparison purposes the recovery pattern of EVA polymer aerated into expanded foam that is commonly used in athletic footwear. This material is considered unsuitable for use in an article of footwear, from the perspective of the present invention, because it is too resilient. The resiliency index of the EVA polymer is about 0.714.

Figure 2:
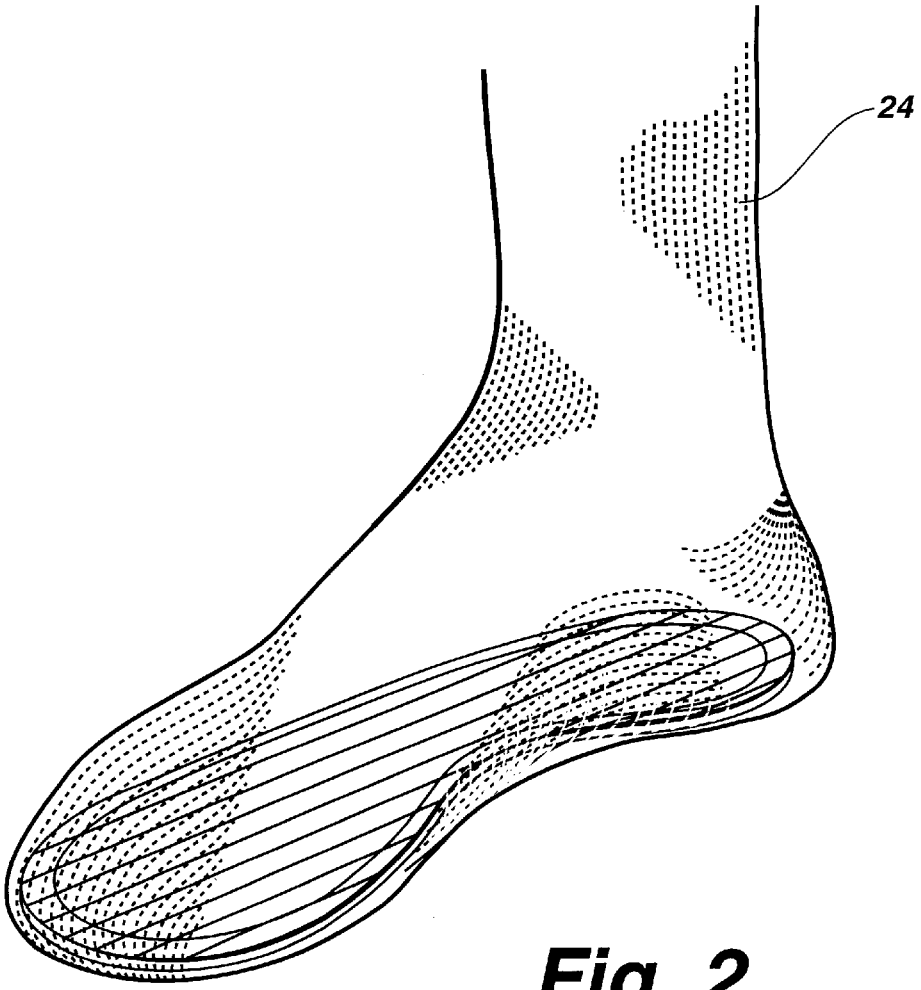
FIG. 2 is a perspective view of a sock incorporating the sole in accordance with the present invention.

A variant of the invention is illustrated in FIG. 2. Here, the improved sole is made part of a sock 24. More particularly, the sole is sewn or otherwise attached to the material enclosing the foot, so it faces the plantar surface of the foot.

The above description of preferred embodiments should not be interpreted in any limiting manner since variations and refinements are possible without departing from the spirit of the invention. The scope of the invention is limited by the terms of the following claims and their equivalents.

I claim:

1. A sole for use in an article of footwear in proximity to a plantar surface of a foot, said sole having a resiliency index in the range from about 0.05 to about 0.5, the resiliency index being defined as a ratio (R–M)/(P–M), wherein P is a thickness measured when only a pre-load is applied, M is a thickness measured when both the pre-load and a main load are applied, and R is the maximum recovered thickness within one second immediately following removal of the main load.

2. A sole as defined in claim 1, having a resiliency index in the range from about 0.1 to about 0.35.

3. A sole as defined in claim 1, having a resiliency index in the range from about 0.1 to about 0.2.

4. A sole as defined in claim 1, having a thickness in the range from about 2 millimeters to about 50 millimeters.

5. A sole as defined in claim 4, having a thickness in the range from about 5 millimeters to about 25 millimeters.

6. A sole as defined in claim 4, having a thickness in the range from about 12 millimeters to about 20 millimeters.

7. A sole as defined in claim 1, having a hardness in the range from about Shore A2 to about Shore A 40.

8. A sole as defined in claim 1, including synthetic material.

9. An article of footwear including a sole in proximity of a foot receiving surface of said article of footwear, said sole having a resiliency index in the range from about 0.05 to about 0.5, the resiliency index being defined as a ratio (R–M)/(P–M), wherein P is a thickness measured when only a pre-load is applied, M is a thickness measured when both the pre-load and a main load are applied, and R is the maximum recovered thickness within one second immediately following removal of the main load.

10. An article of footwear as defined in claim 9, wherein said sole has a resiliency index in the range from about 0.1 to about 0.35.

11. An article of footwear as defined in claim 9, wherein said sole has a resiliency index in the range from about 0.1 to about 0.2.

12. An article of footwear as defined in claim 9, wherein said sole has a thickness in the range from about 2 millimeters to about 50 millimeters.

13. An article of footwear as defined in claim 9, wherein said sole has a thickness in the range from about 5 millimeters to about 25 millimeters.

14. An article of footwear as defined in claim 9, wherein said sole has a thickness in the range from about 12 millimeters to about 20 millimeters.

15. An article of footwear as defined in claim 9, wherein said sole has a hardness in the range from about Shore A 2 to about Shore A 40.

16. An article of footwear as defined in claim 9, wherein said sole includes synthetic material.

17. An article of footwear as defined in claim 9, wherein said sole has an upper surface constituting said foot receiving surface.

18. An article of footwear as defined in claim 9, wherein said article of footwear is selected from the group consisting of a shoe, boot and sock.

* * * * *

US006343426C1

(12) EX PARTE REEXAMINATION CERTIFICATE (8981st)

United States Patent

Robbins

(10) Number: US 6,343,426 C1

(45) Certificate Issued: Apr. 24, 2012

(54) RESILIENT SOLE FOR USE IN ARTICLES OF FOOTWEAR TO ENHANCE BALANCE AND STABILITY

(76) Inventor: Steven E. Robbins, Dollard des Ormeaux (CA)

Reexamination Request:
No. 90/010,402, Feb. 25, 2009

Reexamination Certificate for:

| | |
|---|---|
| Patent No.: | **6,343,426** |
| Issued: | **Feb. 5, 2002** |
| Appl. No.: | **08/873,876** |
| Filed: | **Jun. 12, 1997** |

Related U.S. Application Data

(63) Continuation of application No. 08/583,512, filed on Jan. 5, 1996, now abandoned, which is a continuation-in-part of application No. 08/366,587, filed on Dec. 29, 1994, now abandoned.

(51) Int. Cl.
*A43B 5/00* (2006.01)

(52) U.S. Cl. ..... 36/25 R; 36/44

(58) Field of Classification Search ..... None
See application file for complete search history.

(56) References Cited

To view the complete listing of prior art documents cited during the proceeding for Reexamination Control Number 90/010,402, please refer to the USPTO's public Patent Application Information Retrieval (PAIR) system under the Display References tab.

*Primary Examiner*—Glenn K. Dawson

(57) ABSTRACT

A resilient sole for use in an article of footwear. The sole has controlled stiffness and manifests a slow shape recovery following compression by the plantar surface of the foot. A footwear construction using a sole with such characteristics improves stability of users of all age groups, while enhancing comfort.

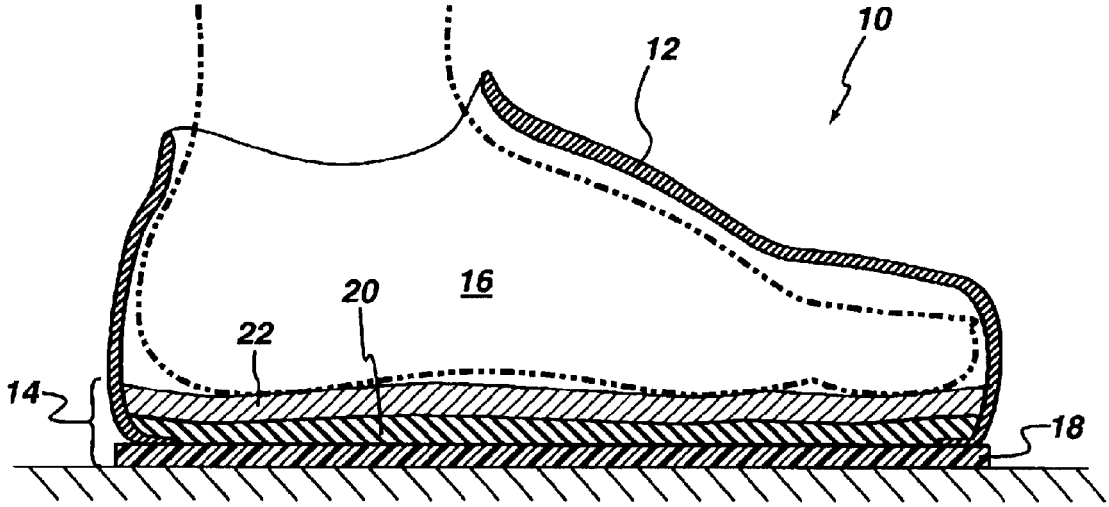

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 7 and 15 is confirmed.

Claims 1-6, 8-14 and 16-18 are cancelled.

* * * * *